United States Patent [19]

Toda et al.

[11] 4,341,821

[45] Jul. 27, 1982

[54] METHOD OF APPLYING WATER-BASE PAINT

[75] Inventors: Kimio Toda; Yasuo Tokushima, both of Toyota, Japan

[73] Assignee: Toyota Jidosha Kogyo Kabushiki Kaisha, Toyota, Japan

[21] Appl. No.: 963,894

[22] Filed: Nov. 27, 1978

Related U.S. Application Data

[63] Continuation of Ser. No. 650,711, Jan. 20, 1976, abandoned.

[30] Foreign Application Priority Data

Jan. 25, 1975 [JP] Japan ..... 50-10647

[51] Int. Cl.[3] ..... B05D 3/00

[52] U.S. Cl. ..... 427/299; 427/335; 427/336; 427/340; 427/407.1; 427/409; 427/421; 427/426

[58] Field of Search ..... 427/421, 424, 426, 402, 427/214, 335, 336, 307, 340, 409, 407.1, 302, 299, 318, 246; 264/391, 393; 134/31

[56] References Cited

U.S. PATENT DOCUMENTS

| | | | |
|---|---|---|---|
| 2,018,508 | 10/1935 | Barnard | 427/302 |
| 2,121,717 | 6/1938 | Sullivan | 427/302 |
| 2,526,431 | 10/1950 | Strickhouser | 427/302 |
| 2,715,587 | 8/1955 | Armitage et al. | 427/336 |
| 3,218,187 | 11/1965 | Wade | 427/302 |
| 3,218,191 | 11/1965 | Domanski | 427/302 |
| 3,515,585 | 6/1970 | Chamberlin | 427/336 |
| 3,574,070 | 4/1971 | Sahely | 427/307 |
| 3,922,470 | 11/1975 | Amano et al. | 427/336 |
| 3,936,542 | 2/1976 | Cox | 427/302 |
| 4,156,667 | 5/1979 | Turpin | 427/388.4 |
| 4,210,565 | 7/1980 | Emmons | 427/388.4 |

*Primary Examiner*—Norman Morgenstern
*Assistant Examiner*—Janyce A. Bell
*Attorney, Agent, or Firm*—Brisebois & Kruger

[57] ABSTRACT

A method of applying water-base paint in which a solvent which increases the viscosity of water-base paint is sprayed on the article to be painted before or after the application of the water-base paint, or at the same time as its application, or a paint compounded with a solvent which increases the viscosity of the water-base paint is sprayed on the article before or after the application of the water-base paint or at the same time that it is applied.

9 Claims, 13 Drawing Figures

THE ADDITIVE QUANTITY OF AN ORGANIC SOLVENT TO THE PAINT A(WATER EMULSION PAINT)

METHOD OF APPLYING WATER-BASE PAINT

This is a continuation of application Ser. No. 650,711, filed Jan. 20, 1976, now abandoned.

BACKGROUND OF THE INVENTION

Water-base paint, the solvent of which consists mainly of water, has the drawbacks that it is slow to evaporate, has a strong surface tension, permits only a narrow latitude for solvent composition; and it is liable to develop the following paint defects, especially at high humidities (of over 70% relative humidity).

Major defects likely to occur are (1) The applied paint may run down under the influence of gravity while the film is still wet and fluid.

(2) The applied paint may concentrate at a sharp bend in the object to be painted or the paint applied to other parts may run down and collect at such a sharp bend.

(3) The solvent may suddenly evaporate or a bubble therein may break where the film is thick due to collection of applied paint.

(4) The paint may be irregularly distributed when metallic paint is used.

(5) The metal in the paint may be attracted to a sharp bend in the object to be painted while a wet metallic paint is fluid and its surface tension is strong.

(6) The applied paint may form a "picture frame", when attracted to the edges of the object to be painted while the wet paint is fluid and the surface tension is strong.

Water-base paint here should be understood to include water emulsion paints, the water-dispersion paints and water-soluble paints.

BRIEF SUMMARY OF THE INVENTION

The method of applying water-base paint according to the present invention can prevent various painting defects even at high humidities without the use of additional equipment such as a dehumidifier or a heater to be used at flash-off, and it consumes far less organic solvent than the conventional method.

BRIEF DESCRIPTION OF ATTACHED DRAWINGS

DETAILED DESCRIPTION OF THE INVENTION

The present invention relates to an improvement in the method of applying water-base paint.

In recent years from the standpoint of environment protection, water and air and noise pollution have become controversial public issues. In the field of painting, the organic solvent emission from painting booths or drying furnaces is drawing attention as an air contaminant. Thus water-base paint, which is free from ignition or explosion and unlikely to be a source of air pollution, has come to be regarded as a desirable material.

Figure 1:
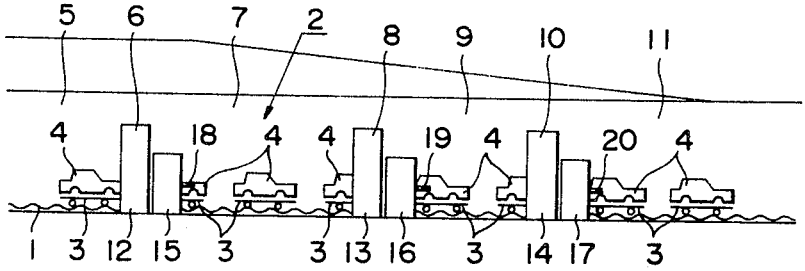
FIG. 1 is a side view showing the general process of applying the top paint coat to the outer plating of an automobile.
Figure 2:
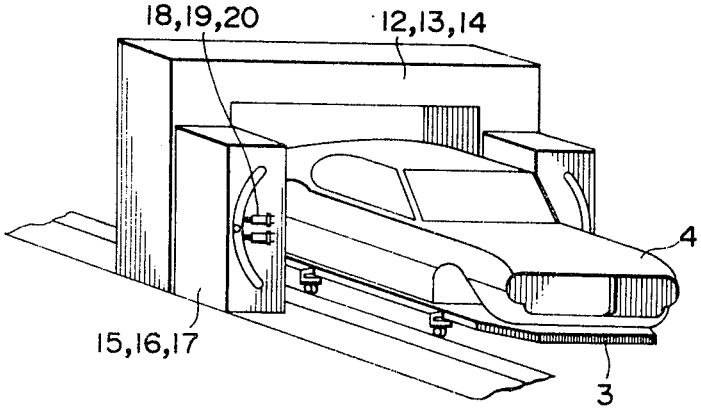
FIG. 2 is an oblique view of the spraying zone of FIG. 1.

First an example of the conventional painting method is illustrated in FIG. 1, which shows a general process of applying the top coat paint to the outer plating of an automobile, and in FIG. 2, which is an oblique view of the spray zone of FIG. 1.

An object 4, which is to be painted, and which has been brought into the painting booth 2 on the truck 3 carried by the conveyor 1 passes through the preparation room 5 and reaches the drying station after passing through the first spray zone 6, the first flash-off zone 7, the second spray zone 8, the second flash-off zone 9, the third spray zone 10 and the setting zone 11. In these spray zones 6, 8, 10 are installed reciprocating-type horizontal automatic painting machines 12, 13, 14 for painting the horizontal surface of the object 4 and reciprocating-type vertical automatic painting machines 15, 16, 17 for painting the right and left vertical surfaces thereof. The horizontal automatic painting machines 12, 13, 14 are each provided with two sets of spray guns 18, 19, 20, while the vertical automatic painting machines are each provided with one set of spray guns 18, 19, 20. Paint is ejected from each spray gun to paint the object 4.

Figure 3:
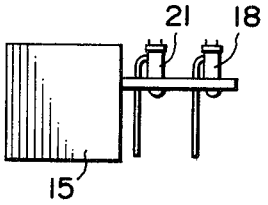
FIGS. 3 to 8 are plan views and side views of the positions of spray guns to be used in the method according to the present invention.

As compared with the conventional method described above, the present invention is characterized in that:

(1) An additional spray gun 21 is installed just before the spray gun 18, as shown in FIG. 3 and a solvent which increases the viscosity of water-base paint or a paint compounded with such a solvent is sprayed out of said spray gun 21, after which water-base paint is applied using the spray gun 18.

Figure 4:
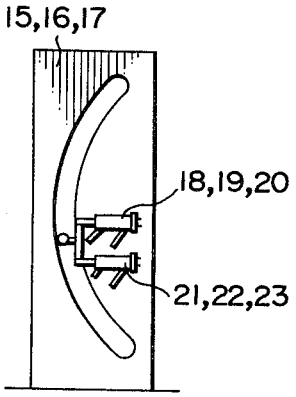
Figure 5:
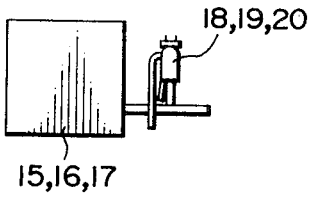

(2) Alongside the conventional spray guns 18, 19, 20 are other spray guns 21, 22, 23, as shown in FIGS. 4 and 5, and a viscosity-increasing solvent or a paint compounded with such a solvent is sprayed from the guns 21, 22, 23, at the same time that a water-base paint is sprayed from the guns 18, 19, 20.

Figure 6:
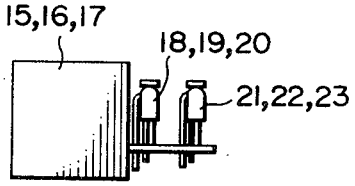

(3) Alternatively, additional spray guns 21, 22, 23, are provided as illustrated in FIG. 6 and a viscosity-increasing solvent or a water-base paint compounded with such a solvent is sprayed from the guns 21, 22, 23, after application of a water-base paint, by means of spray guns 18, 19, 20.

Figure 7:
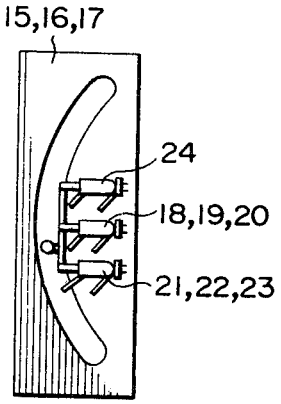
Figure 8:
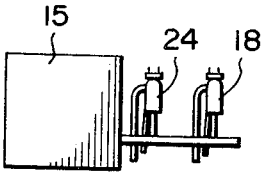

(4) In yet another arrangement illustrated in FIGS. 7 and 8, the spray guns 21, 22, 23, are arranged in parallel with the spray guns 18, 19, 20, while on the other hand a spray gun 24 is attached only to the vertical automatic painting machine 15 so that said gun 24 may paint the object 4 before the guns 18 and 21 do so.

Specific embodiments of the present invention will be hereinafter described. For the sake of simplicity, the description will be limited to the painting of the right vertical surface of the object 4.

EXAMPLE 1

The vertical automatic painting machines 15, 16, 17, are respectively equipped with spray guns 18, 19, 20. For the purpose of carrying out a painting operation according to the present invention, an additional spray gun 21 was attached in advance of the spray gun 18 (which is the first of conventional row of guns), as shown in FIG. 3. A water emulsion paint having the composition B described below, and which had been compounded with a viscosity-increasing solvent, for instance, butylcarbitol or butylcellosolve was sprayed from the gun 21 and thereafter a water emulsion paint of the composition A described below was sprayed from the gun 18 under the following conditions.

TABLE 1

| COMPOSITION B | |
|---|---|
| Resin | Acrylmelamine |
| Solids in spray | 23 weight % |
| Viscosity of spray | 40 sec/20° C. (Ford cup #4) |
| Organic solvent in volatile content | 69 weight % (balance water) |
| Organic solvent used | Butyl carbitol (99% by weight of solvent)<br>Isopropylalcohol (1% by weight of solvent) (Hereafter referred to as IPA) |

TABLE 2

| COMPOSITION A | |
|---|---|
| Resin | Acrylmelamine |
| Solids in spray | 42 weight parts |
| Viscosity of spray | 30 sec/20° C. (Ford cup #4) |
| Organic solvent in volatile content | 10 weight parts (balance water) |
| Organic solvent used | Butyl carbitol (70% by weight of solvent)<br>IPA (30% by weight of solvent) |

TABLE 3

| PAINTING CONDITIONS | |
|---|---|
| Booth temperature | 25° C. |
| Booth humidity | 70~75% RH |
| Gun speed | 0.8 m/sec |
| Gun sweep | 90 cm |
| Conveyor speed | 4 m/min |
| Spray guns | Guns 18, 19, 20, 21 are "Devil screw" JGA502 using cap 777 |
| Atomizing air pressure | 6 $Kg/cm^2$ in 18, 19, 20; and 5 $Kg/cm^2$ in 21 |
| Spray distance | 30 cm average for each gun |
| Pattern width | 30 cm average for each gun |
| Ejection | Paint A atomized at 400 ~450 cc/min by the guns 18, 19, 20; and paint B atomized at 100 cc/min by the gun 21 |
| Gap between the guns 18 and 21 | 30 cm |
| First flash-off time | 5 minutes |
| Second flash-off time | 3 minutes |

TABLE 3-continued

| PAINTING CONDITIONS | |
|---|---|
| Setting time | 7 minutes |
| Drying | From setting time temperature of about 25° C., the temperature was raised approximately linearly in 10 minutes to 150° C. and for 20 minutes thereafter baked to dry at 150° C. |

The results were evaluated in terms of the defects in the paint film according to the following rating criteria:

: satisfactory

Δ: unsatisfactory

X: rejected

TABLE 4

| Evaluation of the results of spraying paint A (water emulsion paint) after spraying paint B (water emulsion paint compounded with a viscosity-increasing solvent) | |
|---|---|
| Defects defined in "Background of the Invention" | Rating |
| Defect (1) | ○ |
| Defect (2) | ○ |
| Defect (3) | ○ |
| Defect (4) | ○ |
| Defect (5) | ○ |
| Defect (6) | ○ |

Note . . . film thickness 40~45μ

In this example, when the application of the paint B was immediately followed by the application of the paint A by means of the guns 18, 19, 20, the viscosity-increasing solvent in the film formed by the paint B acted on the paint A applied thereafter and with the wet film acquiring an increased viscosity, the paint defects could be prevented as shown by Table 4.

COMPARATIVE EXAMPLE 1

Painting was carried out in a conventional manner under the same conditions as in Example 1, except that the step of spraying the paint B out of the spray gun 21 was omitted. The results are summarized in Table 5.

TABLE 5

| Evaluation of the results of the paint A being sprayed by the conventional method | |
|---|---|
| Defects | Rating |
| (1) | Δ |
| (2) | Δ |
| (3) | X |
| (4) | ○ ~Δ |
| (5) | X |
| (6) | ○ ~Δ |

In this comparative example in which the painting was carried out without the preliminary application of a paint containing a viscosity-increasing solvent as proposed by the present invention, the wet film flowed and, as illustrated in Table 5, the results were highly defective, testifying to the superiority of the method of painting according to the present invention. To sum up, the following two effects account for the superiority of the present invention:

(1) the flow of wet film is prevented by the hanging effect caused by the retaining interaction between the paint coatings and (2) the viscosity-increasing solvent in the first paint applied increases the viscosity of the wet film of the second paint.

EXAMPLE 2

Figure 9:
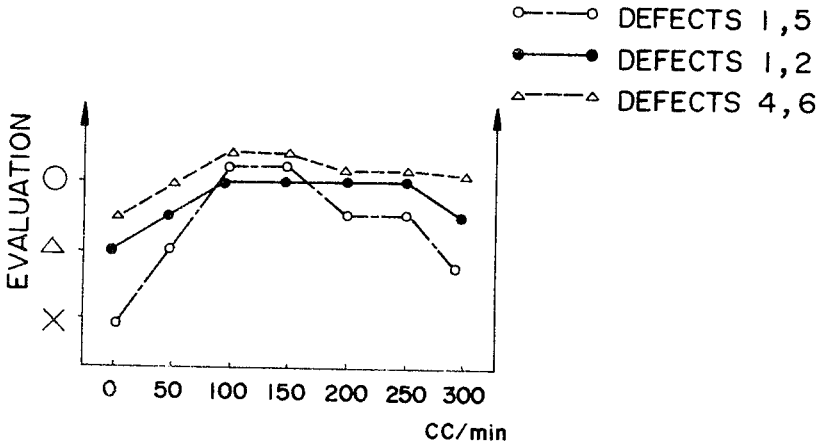
FIG. 9 is a graph of painting defects which happen when the compounded amount of the viscosity-increasing solvent is varied in an embodiment of the present invention.

Painting was carried out under the same conditions as in Example 1 except that the rate of ejection of the paint B was varied over the range of 0 cc/min ~300 cc/min by increments of 50 cc/min. The results are summarized in FIG. 9.

Figure 10:
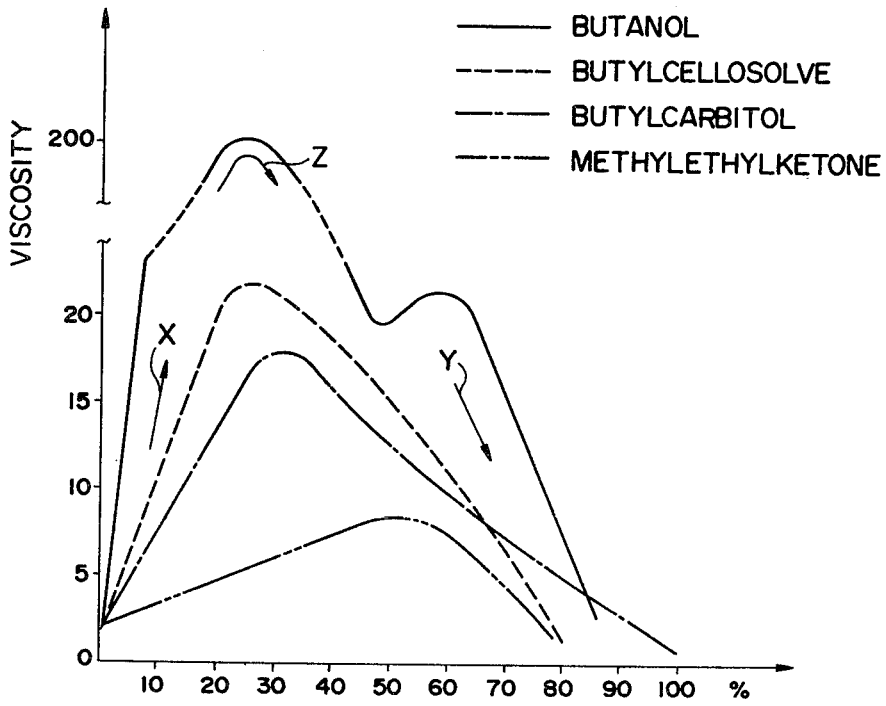
FIG. 10 is a graph illustrating the content of viscosity-increasing solvent in a water emulsion paint vs. the viscosity of the paint.

According to the results of this example, when the consumption of the paint compounded with a viscosity-increasing solvent in the preliminary painting was low, the viscosity-increasing effect was poor; but when its consumption exceeded a certain limit, (1) on account of the excessive solvent which decreased the viscosity as illustrated by the line y to the right of the peak z in FIG. 10, and (2) on account of decreasing the hanging effect the painting defects increased. Thus the rate of ejection mentioned in Example 1 was found the most appropriate in the preliminary painting. Too much application of a paint compounded with too much viscosity-increasing solvent is not desirable, because it results in too much emission of the organic solvent out of the booth-drying furnace, thereby causing air pollution.

EXAMPLE 3

The organic solvent butylcarbitol in the paint B of Example 1 was replaced with those listed in Table 6 and the paints C, D, E were prepared. Otherwise the same conditions as in Example 1 were adopted for painting.

TABLE 6

COMPOSITIONS OF PAINTS C~E

| Paints | Solids in Spray (Weight %) | Viscosity of Spray | Organic solvent in volatile content (weight %) | Organic solvents used and their proportions |
|---|---|---|---|---|
| C | 25 | 40 sec. | 63 | Butylcellosolve + IPA (99:1) |
| D | 25 | 40 sec. | 63 | Butylcellosolve, butyl-alcohol, IPA (50:50:1) |
| E | 25 | 40 sec. | 63 | Butylcellosolve, methyl-ethyl-ketone, IPA (50:50:1) |

The results are summarized in Table 7.

TABLE 7

Painting defects when paint A was sprayed after preliminary application of paint C, D or E

| | Defect (1) | (2) | (3) | (4) | (5) | (6) | Texture |
|---|---|---|---|---|---|---|---|
| Paint C | ○ | ○ | ○ | ○ | ○ | ○ | ○ |
| Paint D | ○ | ○ | ○ | ○~Δ | ○~Δ | ○ | ○ |
| Paint E | ○~Δ | ○~Δ | ○~Δ | ○ | ○ | ○ | Δ |

In Example 3, other solvents available for increasing the viscosity are mentioned and between their amounts and viscosity a relationship illustrated in FIG. 10 exists. Also cellosolve base solvents, carbitol base solvents and amines are suitable.

EXAMPLE 4

The conditions with respect to the paint A in Example 1 were changed to the conditions given in Table 8; the rate of ejection from the spray guns 18, 19, 20 was set at 400 cc/min for the paint F, at 500–550 cc/min for the paint G and at 450 cc/min for the paint H. Otherwise the same conditions as in Example 1 were adopted for painting.

TABLE 8

Compositions of paints F, G, H

| Paints | Solids in Spray | Resin | Organic solvent in volatile content | Organic solvent used |
|---|---|---|---|---|
| F | 45% by weight | Acryl-mela-mine | 5% by weight | IPA alone |
| G | 32% by weight | Acryl-mela-mine | 25% by weight | Butyl-carbitol: IPA = 6:1 |
| H | 41% by weight | Acryl-mela-mine | 5% by weight | IPA alone |

Note 1 - "Silver metallic" was compounded in this example.
2 - Viscosity of spray = 30 sec/20° C. (Ford cup #4).

The results are summarized in Table 9.

TABLE 9

Defects when paint F, G, or H was sprayed after preliminary application of paint B in Example 1

| Paints | Defect (1) | (2) | (3) | (4) | (5) | (6) | Others |
|---|---|---|---|---|---|---|---|
| F | ○ | ○~Δ | ○~Δ | ○ | ○ | ○ | ○ |
| G | ○~Δ | ○ | ○ | ○ | ○ | ○ | ○ |
| H | ○ | ○~Δ | ○~Δ | X | ○ | ○ | Metal becoming "Hammertone" |

This example indicates that the metal distribution is affected by the composition and rate of ejection of a water emulsion paint in the main painting step.

COMPARATIVE EXAMPLE 2

The step of spraying paint B from the spray gun 21 in Example 4 was omitted. Otherwise the painting conditions were the same as in Example 4. The results are summarized in Table 10.

TABLE 10

Defects after paint F, G or H has been applied

| Paints | Defect (1) | (2) | (3) | (4) | (5) | (6) |
|---|---|---|---|---|---|---|
| F | ○ | X | Δ | ○ | ○ | ○ |
| G | Δ | Δ | Δ | ○ | ○ | ○ |
| H | Δ | X | X | ○ | ○ | ○ |

EXAMPLE 5

Paint A in Example 1 was replaced with paint I given in Table 11; paint B was replaced with paint II in Table 12; and the paint was sprayed at a rate of 500~550 cc/min from the guns 18~20. Otherwise the painting conditions were the same as in Example 1. Painting defects were evaluated in accordance with the rating criteria used for Example 1.

TABLE 11

| Composition of paint I (water-dispersion type) | |
|---|---|
| Resin | Acrylmelamine |
| Solids in spray | 32% by weight |
| Viscosity of spray | 30 sec/20° C. (Ford cup #4) |
| Organic solvent in volatile content | 12% by weight |
| Organic solvent used | Butylcarbitol: IPA = 1:9 |

TABLE 12

| Composition of paint II (water-dispersion type compounded with a viscosity-increasing solvent) | |
|---|---|
| Resin | Acrylmelamine |
| Solids in spray | 19% by weight |
| Viscosity of spray | 40 sec/20° C. (Ford cup #4) |
| Organic solvent in volatile content | 57% by weight |
| Organic solvent used | Butylcarbitol: IPA = 9:1 |

The results are summarized in Table 13.

TABLE 13

| Defects when paint I (water-dispersion type) was sprayed after preliminary application of paint II (water-dispersion type compounded with a viscosity-increasing solvent) | |
|---|---|
| Defects | Rating |
| (1) | ○ |
| (2) | ○ |
| (3) | ○ |
| (4) | ○~Δ |
| (5) | ○ |
| (6) | ○ |

This is an example of the method according to the invention being applied to the use of a water-dispersion paint. It shows that even in the case of a water-dispersion paint, just as in the case of the water emulsion paint, satisfactory results can be obtained by painting after the preliminary application of a viscosity-increasing solvent or a paint compounded with such a solvent. Moreover it is seen from FIG. 11 that even the water dispersion paint tends to have its viscosity increased by the application of a certain solvent. In Example 5 this solvent was butylcarbitol. Obviously the results are better with fewer defects when the paint I is sprayed after the preliminary application of the paint II in Example 5 than when the preliminary application is omitted as in the following comparative Example 3.

Also it is known that the composition of a water-soluble paint can be somewhat modified to increase its viscosity by the use of a certain solvent. Thus the method according to the invention is found applicable to water-soluble paint as well as to water emulsion paint and the water dispersion paint.

COMPARATIVE EXAMPLE 3

Spraying of paint II out of the gun 21 in Example 5 was omitted. The other painting conditions were the same as in Example 5. The painting defects were rated in the same way as in Example 1. The results are summarized in Table 14.

TABLE 14

| Defects when paint I (water-dispersion type) was sprayed without preliminary painting (conventional method) | |
|---|---|
| Defects | Rating |
| (1) | Δ~X |
| (2) | Δ~X |
| (3) | Δ~X |
| (4) | Δ |
| (5) | X* |
| (6) | ○ |

*Disqualified on account of metal flow.

EXAMPLE 6

Paint B in Example 1 was replaced with a solvent a, b or c of Table 15 and sprayed from the gun 21 at a rate of 50 cc/min. Othewise the painting conditions were the same as in Example 1. The painting defects were rated in the same way as in Example 1.

TABLE 15

| Compositions of Solvents a, b, c | |
|---|---|
| Solvents | Composition |
| a | Butylcarbitol |
| b | Butylcellosolve |
| c | Butanol:butylcellosolve = 1:1 |

The results are summarized in Table 16.

TABLE 16

| Defects when paint A (water emulsion paint) was sprayed after preliminary application of solvent a, b or c | | | | | | |
|---|---|---|---|---|---|---|
| | Rating of defects | | | | | |
| Solvents | (1) | (2) | (3) | (4) | (5) | (6) |
| a | ○ | ○ | ○ | ○ | ○ | ○ |
| b | ○ | ○ | ○ | ○ | ○ | ○ |
| c | ○ | ○ | ○ | ○~Δ | ○~Δ | ○ |

In this example the paint was sprayed after the preliminary application of a solvent. Table 16 shows that in this case too the results are good. It should be noted that the ejection of the solvent from the gun 21 must be such as not to cause defect (1) after painting of the object.

EXAMPLE 7-①

The vertical automatic painting machines 15, 16, 17 are respectively equipped with spray guns 18, 19, 20. For the purpose of carrying out the process according to the invention, as indicated in FIGS. 4, 5, the spray guns 21, 22, 23 were additionally provided in parallel with the guns 18, 19, 20. Under the conditions given in Table 18, the object was simultaneously sprayed with a water emulsion paint (hereafter referred to as paint J) having the composition shown in Table 17 from the guns 18, 19, 20, and with the solvent butylcarbitol (hereafter referred to as solvent a) from the guns 21, 22, 23.

TABLE 17

| Composition of water emulsion paint (paint J) | |
|---|---|
| Resin | Acrylmelamine |
| Solids in spray | 45% by weight |
| Viscosity of spray | 30 sec/20° C. (Ford cup #4) |
| Organic solvent in volatile content | 5% by weight (balance water) |
| Organic solvent | IPA |

TABLE 17-continued

| Composition of water emulsion paint (paint J) |
|---|
| used |

TABLE 18

| Painting conditions | |
|---|---|
| Booth temperature | 25° C. |
| Booth humidity | 75% RH |
| Gun speed | 0.8 m/sec |
| Gun sweep | 90 cm |
| Conveyor speed | 4 m/min |
| Spray guns | Guns 18–23 are "devil screw" JGA502 using 777 cap |
| Atomizing air pressure | 6 Kg/cm in guns 18–23 |
| Spray distance | 30 cm average for each gun |
| Ejection | Paint J ejected at a rate of 400~450 cc/min from guns 18–20<br>Solvent a ejected at a rate of 55~60 cc/min from guns 21–23 |
| First flash-off time | 5 minutes |
| Second flash-off time | 3 minutes |
| Setting time | 7 minutes |
| Drying | 150° C., 30 minutes |

Under the above conditions, the object was painted to a film thickness of 40~45μ, the results being summarized in Table 19.

TABLE 19

| Defects when paint J and solvent "a" are simultaneously sprayed | |
|---|---|
| Defects | Rating |
| (1) | ○ |
| (2) | ○ |
| (3) | ○ |
| (4) | ○ |
| (5) | ○ |
| (6) | ○ |

As seen from Table 19, when paint J and a small amount of solvent "a" were simultaneously sprayed, the results turned out to be satisfactory even at a high humidity of the booth (75% relative humidity) with no occurrence of defects.

EXAMPLE 7-②

The vertical automatic painting machines 15, 16, 17 are respectively equipped with the spray guns 18, 19, 20. For the purpose of carrying out the process according to the invention, as indicated in FIGS. 7, 8, the additional guns 21, 22, 23 were attached after the guns 18, 19, 20. After the preliminary application of the water emulsion paint J by means of guns 18, 19, 20, the object 4 was sprayed with solvent "a" from the guns 21, 22, 23 under the conditions given in Table 18. Thus the object 4 was coated to a film thickness of 40~45μ and the results were evaluated in the same way as in Example 1. They turned out to be the same as in Table 19 of Example 7-①.

It was thus confirmed that when a small amount of a viscosity-increasing solvent "a" is sprayed after the application of paint J, the results are satisfactory even at a high booth humidity of 75% relative humidity, with no occurrence of defects.

EXAMPLE 8-①

Solvent "a" in Example 7 was replaced with solvent "b", "c" or "d" in Table 20. Otherwise the painting conditions were the same as in Example 7.

TABLE 20

| Compositions of solvents b, c, d | |
|---|---|
| Solvents | Organic solvents used and their proportions |
| b | Butylcellosolve |
| c | Butylcellosolve + butylalcohol (1:1) |
| d | Butylcellosolve + methylethylketone (1:1) |

The results are summarized in Table 21.

TABLE 21

| Defects when paint J and a solvent listed in Table 20 are simultaneously sprayed | | | |
|---|---|---|---|
| | Rating | | |
| Defects | Solvent b | c | d |
| (1) | ○ | ○ | ○~Δ |
| (2) | ○ | ○ | ○~Δ |
| (3) | ○ | ○ | ○~Δ |
| (4) | ○ | ○~Δ | ○~Δ |
| (5) | ○ | ○~Δ | |
| (6) | ○ | ○ | |

It is seen from Table 21 that even if the solvent "a" in Example 7 is changed to the solvent "b" or "c", the results are good when it is sprayed at the same time as the paint J. If the solvent "d" is used instead of "a", some slight development of defects is observed. This is presumably due to the inferiority of the viscosity-increasing effect of methylethylketone.

EXAMPLE 8-②

Using the same solvents as in ①, the experimental results turned out to be the same as indicated in Table 21.

According to Table 21, even if the solvent "b" or "c" is used instead of "a" in Example 7, the results are good when spraying is carried out after the application of paint J. It is presumably due to the inferiority of the viscosity-increasing effect of methylethylketone that defects occur to a slight degree when the solvent "d" is employed instead of "a".

EXAMPLE 9- 1

Instead of solvent "a" in Example 7, the paints B, C, D, E were used and were ejected from the guns 21, 22, 23 at 80 cc/min. Otherwise the painting conditions were the same as in Example 7. The results are summarized in Table 22.

TABLE 22

| Defects when paint A and paint B, C, D or E are simultaneously sprayed | | | | |
|---|---|---|---|---|
| | Rating | | | |
| Defects | Paint B | C | D | E |
| (1) | ○ | ○ | ○ | ○~Δ |
| (2) | ○ | ○ | ○ | ○~Δ |
| (3) | ○ | ○ | ○ | ○~Δ |
| (4) | ○ | ○ | ○ | ○ |
| (5) | ○ | ○ | ○ | ○ |
| (6) | ○ | ○ | ○ | ○ |

As indicated in Table 22, it is obvious that good results are obtained even when the paint B, C, D or E is used instead of solvent "a" in Example 7 and sprayed at the same time as the paint J. The good results are attributable to the fact that the paint B is a paint J to which about 100% by weight of solvent "a" has been added, and which has been adjusted to a spray viscosity of 40 sec/20° C. (Ford cup #4), and a viscosity-increasing agent has also been added to the paints C~E to insure affinity with the paint J (a water emulsion paint). Especially in the case of a metallic paint, better results will be expected from the simultaneous spraying of a paint having a high affinity, which has a high viscosity-increasing effect than from the simultaneous spraying of solvent "a" in Example 7.

EXAMPLE 9-②

Using the same solvent as in ①, the experimental results turned out the same as in Table 22.

As indicated in Table 22, good results are obtained even when the paints B, C, D or E are used instead of solvent "a" in Example 7, and when they are sprayed after the application of the paint J.

EXAMPLE 10-①

In this example instead of paint J in Example 7 the water emulsion paints K~M in Table 23 were employed and in order to form a film with a uniform thickness of 40~45μ using these paints, they were ejected from the guns 18, 19, 20 at the values given in Table 23. Otherwise the conditions were the same as in Example 7. The paint J was also tested as a control.

TABLE 23

Compositions of water emulsion paints K~M

| Paints | Solids in Spray (Weight %) | Viscosity of Spray (sec/20° C.) | Organic Solvent in Volatile Content (Weight %) | Organic Solvents Used and their Proportions | Ejection (cc/min) |
|---|---|---|---|---|---|
| J | 45 | 30 | 5 | IPA | 400~450 |
| K | 42 | 30 | 10 | Butylcarbitol: IPA = 1:1 | 450 |
| L | 39 | 30 | 16 | IPA = 11:5 | 450~500 |
| M | 37 | 30 | 22 | IPA = 17:5 | 500 |

The results are summarized in Table 24.

TABLE 24

Defects when paints J, K, L or M are used and solvent "a" is simultaneously sprayed

| Paints | Defect (1) | Metallic finish |
|---|---|---|
| J | ○ | Good |
| K | ○ | " |
| L | ○ | " |
| M | ○ | Excellent |

Note - No other defects occur with any paint.

As indicated in Table 24, it is obvious that good results are obtained even when any of the paints K~M which represent a paint J to which a viscosity-increasing solvent "a" has been added and the solvent "a" are simultaneously sprayed; and the results are the better, the greater the solvent content in the paints K-M.

EXAMPLE 10-②

Using the same paints J-M as in ①, the results were the same as given in Table 24.

As indicated in Table 24, good results can be obtained even when the solvent "a" is sprayed after the application of the paints K-M which are a paint J to which a viscosity-increasing solvent "a" has been added, and the greater the solvent content in the paints K-M, the better the results.

COMPARATIVE EXAMPLE 4-①

In Example 10, the results were better with a paint having a greater solvent content. The rate of ejection out of the guns 21, 22, 23 was adjusted to the value given in Table 24 and the total quantity of organic solvents was kept constant. Defects in the paints K-M and J applied under these conditions were checked.

The total quantity Q of organic solvents in each spray zone during use of a vertical automatic painting machine for one side of an article is found from the following equation:

$Q$ cc/min=(ejection from the guns 21, 22, 23)+[(ejection from the guns 18, 19, 20)×(1−solids in spray)×(organic solvent in volatile content)]

where it is assumed that capacity %=weight %.

For instance, the total quantity of organic solvents per minute of application of paint K can be found as follows:

$$Q_X=45+450\times(1-0.42)\times0.1=45+26=71.$$

TABLE 25

Ejection time of paints K-M and ejection of solvent "a" (per minute)

| Paints | Ejection of solvent "a" out of guns 21, 22, 23 | Consumption of organic solvent per minute in vertical automatic painting machine in each spray zone |
|---|---|---|
| J | 55~60 cc/min | About 70 cc |
| K | 45 | " |
| L | 20 | " |
| M | 0 | " |

The results are summarized in Table 26.

TABLE 26

Defects when any one of paints K~M and J and solvent "a" are simultaneously sprayed

| Paints | Defect (1) | (2) | (3) | (4) | (5) | (6) |
|---|---|---|---|---|---|---|
| J | ○ | ○ | ○ | ○ | ○ | ○ |
| K | ○ | ○ | ○ | ○ | ○ | ○ |
| L | Δ | Δ | ○ | ○ | ○ | ○ |
| M | X | X | Δ | ○ | Δ | ○ |

As indicated in Table 26, good results are obtained without the addition of a viscosity-increasing solvent to the water emulsion paint when the total quantity of the solvent content and the solvent simultaneously sprayed is kept constant.

Considering the stability of paint, however, the addition of a viscosity-increasing solvent is desirable; therefore the solvent content in the paint K is considered practically appropriate.

In Example 10 the results were better when the solvent content in a paint was greater. From the standpoint of pollution, however, too much use of the solvent is not desirable. Thus the consumption of organic solvents should be chosen considering Example 10 and the comparative examples.

COMPARATIVE EXAMPLE 4-②

Using the same paints J~M as in ①, the results were the same as given in Table 26. As shown in Table 26, the same results can be obtained, even when organic solvent is sprayed out of guns 21, 22, 23 (as indicated in Table 25) after the application of the paints K–M.

EXAMPLE 11

In this example, painting was carried out with a paint and a solvent or one paint and another paint introduced through different hoses and using a hand spray gun which permits simultaneous spraying.

Figure 12:
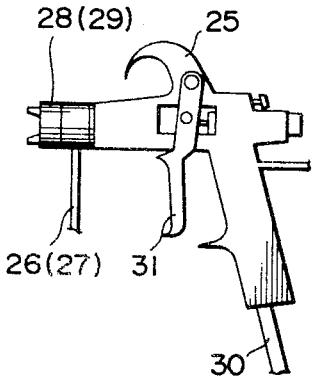
FIG. 12 is a side view of a hand spray gun.
Figure 13:
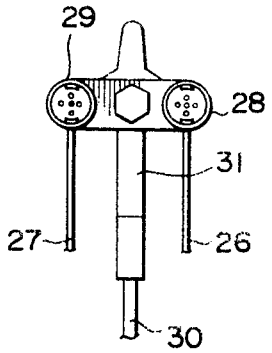
FIG. 13 is a plan view of the gun shown in FIG. 12.

FIG. 12 is a side view showing the hand spray gun employed in this example, and FIG. 13 is a corresponding plan view.

Two hoses 26, 27 are connected to the hand spray gun 25, and a nozzle 28 is attached to the hose 26 and a nozzle 29 to the hose 27. An air hose 30 introduces air which is distributed within the gun 25 to said nozzles 28 and 29.

When the trigger 31 of the gun 25 is pulled, the paint and the solvent or one paint and another paint are separately introduced through the hoses to the nozzles 28 and 29, atomized by the air, and simultaneously sprayed onto the same portion of the object 4.

Using the spray gun 25, and introducing the paint K through the hose 26 and the solvent "a" through the hose 27, a paint film having a thickness of 40~45μ was formed under the conditions listed in Table 28.

TABLE 28

| Painting Conditions | |
|---|---|
| Booth temperature | 25° C. |
| Booth humidity | 75% RH |
| Gun speed | About 0.8 m/sec |
| Painting method | Single - single - double with ⅔ overlap |
| Ejection | Paint F . . . 400 cc/min<br>Solvent "a" . . . 50 cc/min |
| Spray air pressure | 5 Kg/cm$^2$ for spraying |
| Spray distance | About 30 cm average |
| First flash-off time | 5 minutes |
| Second flash-off time | 3 minutes |
| Setting time | 7 minutes |
| Drying time | 30 minutes |

The results were good with no painting defects developed.

EXAMPLE 12-①

Paint J in Example 7 was replaced by the above-mentioned paint I and ejected from the guns 18–20 at 500~550 cc/min. Otherwise the conditions were the same as in Example 7-①. The results were evaluated in the same way as in Example 1.

The results are summarized in Table 29.

TABLE 29

| Defects when paint I (water-dispersion type) and solvent "a" are simultaneously sprayed | |
|---|---|
| Defects | Rating |
| (1) | ○ |
| (2) | ○ |
| (3) | ○ |
| (4) | ○~Δ |

TABLE 29-continued

| Defects when paint I (water-dispersion type) and solvent "a" are simultaneously sprayed | |
|---|---|
| Defects | Rating |
| (5) | ○ |
| (6) | ○ |

As seen from Table 29; the results are equally good even when a water-dispersion paint and a viscosity-increasing solvent are simultaneously sprayed.

EXAMPLE 12-②

Using the same paint I as in ①, the results were the same as given in Table 29. As is evident from Table 29, good results can also be obtained when the spraying of a viscosity-increasing solvent follows the application of a water-dispersion paint.

COMPARATIVE EXAMPLE 6-①

Instead of paint J in Example 7, the paint I in Example 12 was employed; the ejection from the guns 18~20 was at the rate of 500~550 cc/min; and the simultaneous spraying of the solvent "a" was omitted. Otherwise the conditions were the same as in Example 7. Defectiveness was measured in the same way as in Example 1. The results are summarized in Table 30.

TABLE 30

| Defects when paint I (water-dispersion type) alone is sprayed | |
|---|---|
| Defects | Rating |
| (1) | X |
| (2) | Δ~X |
| (3) | X |
| (4) | Δ |
| (5) | X |
| (6) | Δ |

Table 30 shows, when compared with Table 29, that even in the case of a water-dispersion paint the paint defectiveness increases when the spraying of solvent "a" is omitted.

EXAMPLE 13

The vertical automatic painting machines 15, 16, 17 for each spray zone are equipped respectively with the spray guns 18, 19, 20. In the method according to the present invention, as illustrated in FIG. 7, the additional guns 21, 22, 23 are mounted in parallel with the guns 18, 19, 20. In the case of the machine 15 alone, a spray gun 24 which paints the object 4, acting before the guns 18 and 21 do, is provided.

FIG. 7 is a front view of the vertical automatic painting machine for the first spray zone on the right side as viewed from opposite direction to the travel of the belt-conveyor, and FIG. 8 is the corresponding plan view.

Paint B having the above-mentioned composition (water emulsion paint as compounded with a viscosity-increasing solvent) is sprayed from the gun 24 under the conditions listed in Table 31.

TABLE 31

| Painting conditions for Paint B | |
|---|---|
| Ejection | 100 cc/min |
| Air Pressure | 5 Kg/cm$^2$ (in spraying) |
| Spray distance | 30 cm average |
| Separation of | |

TABLE 31-continued

| Painting conditions for Paint B | |
|---|---|
| gun 18 from 24 | 50 cm |

Next the water emulsion paint J and the solvent "a" (butylcarbitol) were sprayed under the conditions listed in Table 32.

TABLE 32

| Painting Conditions | |
|---|---|
| Booth temperature | 25° C. |
| Booth humidity | Over 80% RH |
| Gun speed | 0.8 m/sec |
| Gun sweep | 90 cm |
| Conveyor speed | 4 m/min |
| Spray guns | Guns 18~23 are "Devil screw" JGA502 using cap 777 |
| Atomizing air pressure | 6 Kg/cm$^2$ in guns 18~ 23 |
| Spray distance | 30 cm average for each gun |
| Ejection | Guns 18~20 eject paint A at a rate of 400~450 cc/min<br>Guns 21~23 eject solvent "a" at a rate of 55~60 cc/min |
| First flash-off time | 5 minutes |
| Second flash-off time | 3 minutes |
| Setting time | 7 minutes |
| Drying | 150° C., 30 minutes |

Under the above-mentioned conditions, the object 4 was coated with a paint film 40~45μ in thickness and the defects in the film were examined in the same way as in Example 1. The results are summarized in Table 33.

TABLE 33

| Defects when paint J and solvent "a" are simultaneously sprayed after application of paint B | |
|---|---|
| Defects | Rating |
| (a) | ○ |
| (2) | ○ |
| (3) | ○ |
| (4) | ○ |
| (5) | ○ |
| (6) | ○ |

As seen from Table 33, the present invention prevents the occurrence of painting defects, because a water emulsion paint compounded with a viscosity-increasing solvent is first applied to the object and then both the water emulsion paint and the viscosity-increasing solvent are simultaneously and separately sprayed, thereby establishing an affinity between the first film and the second film and preventing the flow of wet film through the so-called hanging effect, i.e., the retentive effect of the second film, and because the viscosity of the wet film is increased by the viscosity-increasing solvent in the first film and the similar solvent later sprayed on with the water emulsion paint.

EXAMPLE 14

Instead of paint J in Example 13, a paint I of the composition shown in Table 11 was sprayed at a rate of 500~550 cc/min, and instead of paint B in Example 13 a paint II of the composition as shown in Table 12 was employed. Otherwise the conditions were the same as in Example 13. Thus under the painting conditions listed in Table 32 of Example 13 the object 4 was coated with a film 40~45 in thickness and the results were checked for any painting defects in the same way as in Example 1. Table 34 summarizes the results.

TABLE 34

| Defects when paint I and solvent "a" are simultaneously sprayed after application of paint II | |
|---|---|
| Defects | Rating |
| (1) | ○ |
| (2) | ○ |
| (3) | ○ |
| (4) | Δ |
| (5) | ○ |
| (6) | ○ |

As indicated in Table 34, according to the present invention, good results are obtained even when a water-dispersion paint and a viscosity-increasing solvent are simultaneously and separately sprayed after the formation of a film of the water-dispersion paint compounded with the viscosity-increasing solvent.

COMPARATIVE EXAMPLE 7

Preliminary application of the paints B and II by means of the spray gun 24 in Examples 13 and 14 was omitted; and simultaneous spraying of a viscosity-increasing solvent from the guns 21-23 in Examples 13 and 14 was also omitted. Otherwise using the same conditions as in Examples 13 and 14, painting was carried out and the product checked for any defects in the same way as in Example 1, the results being summarized in Table 35.

TABLE 35

| | Defects when paint J or paint I is sprayed alone | | | | | |
|---|---|---|---|---|---|---|
| Paints | (1) | (2) | (3) | (4) | (5) | (6) |
| J | X | X | X | X | X | Δ |
| I | X | X | X | X | X | X |

As seen from Table 35, various painting defects occur when the preliminary application pf paint B or II and the spraying of a viscosity-increasing solvent "a" are omitted.

COMPARATIVE EXAMPLE 8

Only the preliminary application of the paints B and II by means of the gun 24 in Examples 13 and 14 was omitted. Otherwise the conditions were the same as in Examples 13 and 14.

Painting defects were determined in the same way as in Example 1, the results being summarized in Table 36.

TABLE 36

| Defects when paint J or I and a viscosity-increasing solvent "a" are simultaneously sprayed | | | | | | |
|---|---|---|---|---|---|---|
| | Defects | | | | | |
| Paints | (1) | (2) | (3) | (4) | (5) | (6) |
| J + a | ○ | Δ | Δ | Δ | ○ | ○ |
| I + a | Δ | Δ | Δ | X | Δ | Δ |

As seen from Table 36, also when the paint J or I and the viscosity-increasing solvent "a" are simultaneously sprayed, painting defects occur more frequently than in Examples 13 and 14. Thus when a water-base paint is applied at a humidity of over 80% in accordance with References 7 and 8, many painting defects occur, whether the conventional method is followed or both the paint and the viscosity-increasing solvent are simultaneously sprayed.

When a viscosity-increasing solvent such as butylcarbitol, butylcellosolve, butanol or methylethylketone is added to the paint A, the viscosity of the paint increases with the addition of an organic solvent to the paint A, as indicated in FIG. 10. Thus when the amount of the organic solvent added to the paint A is small, the viscosity increases as indicated by the arrow X; but when a large amount is added, the viscosity decreases as indicated by the arrow Y.

Such a change in paint viscosity depending on the addition of organic solvent may be explained as follows: Initially when the addition of organic solvent is small, the organic solvent breaks the colloid particles in the emulsion by swelling them, thereby strengthening the interaction between particles and accordingly increasing the viscosity.

When more organic solvent is added and exceeds a certain limit, the emulsion is completely destroyed and becomes a solution. With further addition of organic solvent, the dissolution progresses, lowering the paint viscosity.

There are solvents other than those employed in the cited examples which exhibit the same tendency as described above. In the present invention the solvents exhibiting such a tendency are called the viscosity-increasing solvents and distinguished from poor solvents like water.

Figure 11:
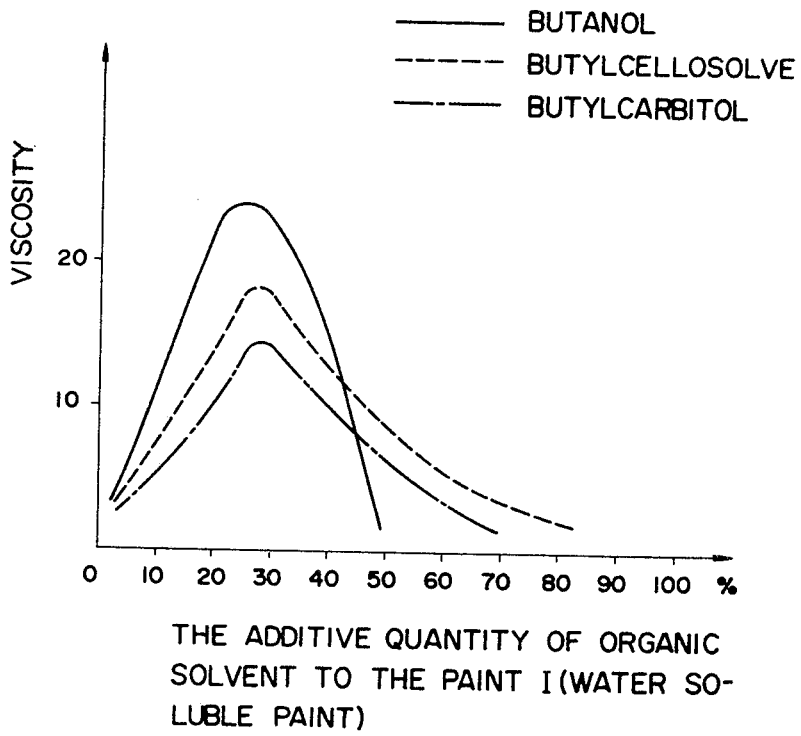
FIG. 11 is a graph illustrating the content of viscosity-increasing solvent in a water-dispersion paint vs. the viscosity of the paint.

For the same reason mentioned, even a water-dispersion paint like the paint I, like a water emulsion paint, has its viscosity increased by a certain solvent, as illustrated in FIG. 11. It is also known that even a water-soluble paint can have its viscosity increased through certain modifications in its composition.

In general practice, a viscosity-increasing solvent such as butylcarbitol or butylcellosolve is added to a water emulsion paint for the purpose of improving its workability. As a result, the paint viscosity is increased as illustrated in FIG. 10. Meanwhile for convenience in spraying, the paint has to be rendered sufficiently less viscous for spraying by the addition of a poor solvent like water. Thus the solids in the paint decrease and the water content increases. In this way, the addition of a viscosity-increasing solvent to the water paint causes a greater fluidity of wet film than in the case of a paint with no addition of a viscosity-increasing solvent. Therefore the addition of a viscosity-increasing solvent to a water-base paint will not be so effective in the prevention of painting defects.

For this reason, according to the invention, at the same time as the application of a water paint, a viscosity-increasing solvent is separately sprayed. Thus under the combined effects of the viscosity-increasing solvent in the paint first applied and the viscosity-increasing solvent later sprayed on together with a water-base paint, the viscosity of the wet film is brought close to the peak Z in FIG. 10, thereby controlling the fluidity of the wet film and preventing the occurrence of painting defects.

As described, the present invention makes it possible to apply a water-base paint even at high humidities on a conventional painting line without any additional equipment such as a dehumidifier or heater to be used in time of flash-off.

According to the method in which the spray is rich in solids, the atomized spraying can be done at low rates of ejection and the consumption of solvent can be reduced as compared with the conventional method. Accordingly the pollution due to exhaust fumes from the booth and drying furnace can be mitigated. Thus the painting method according to the present invention has a great industrial significance.

What is claimed is:

1. In the known process of coating a surface by spraying with a water-base paint which is susceptible to running down or other coating defects after application, the improvement which comprises also applying to said surface before said water-base paint dries a solvent that increases the viscosity of said water-base paint, whereby a smooth glossy coated surface is produced.

2. The method of claim 1 in which said solvent is a viscosity-increasing solvent mixed with some water-base paint and said mixture is applied on said surface separate from said spraying with a water-base paint.

3. The method of claim 1 in which said solvent is applied to said surface immediately after said water-base paint is applied to said surface.

4. The method of claim 1 in which said solvent is a viscosity-increasing solvent mixed with some water-base paint and said mixture is applied immediately after said surface has been first sprayed with a water-base paint.

5. The method of claim 1 wherein said solvent is a viscosity-increasing solvent mixed with some water-base paint and said mixture is applied to a surface and then water-base paint is sprayed on said surface before said solvent evaporates.

6. The method of claim 2 in which additional water-base paint is applied after said mixture of water-base paint and solvent has been applied and while said mixture is still wet.

7. The method of claim 2 in which said water-base paint and solvent are sprayed on to the surface separately but simultaneously.

8. The method of claim 1 in which said water-base paint has a resin content consisting mainly of acrylmelamine resin.

9. The method of claim 1 in which said solvent comprises at least one substance selected from the group consisting of butylcarbitol, isopropyl alcohol, butyl cellosolve, butyl alcohol and methylethylketone.

* * * * *